US006412574B1

(12) United States Patent
Wardley et al.

(10) Patent No.: US 6,412,574 B1
(45) Date of Patent: Jul. 2, 2002

(54) METHOD OF FORMING A SUBSEA BOREHOLE FROM A DRILLING VESSEL IN A BODY OF WATER OF KNOWN DEPTH

(76) Inventors: Mike Wardley, c/o McNeil Business Centre, Greenbank Crescent, East Tullos, Aberdeen AB12 BG; Phillip Strong, c/o Victoria Tower, 63 Market Street, Aberdeen AB11 5PJ, both of (GB)

( * ) Notice: Subject to any disclaimer, the term of this patent is extended or adjusted under 35 U.S.C. 154(b) by 0 days.

(21) Appl. No.: 09/566,121

(22) Filed: May 5, 2000

(30) Foreign Application Priority Data

May 5, 1999 (GB) ..... 9910238

(51) Int. Cl.[7] ..... E21B 7/128; E21B 7/20
(52) U.S. Cl. ..... 175/7; 175/5; 175/171
(58) Field of Search ..... 175/7, 5, 171, 175/215, 230; 166/358

(56) References Cited

U.S. PATENT DOCUMENTS

| | | | | | |
|---|---|---|---|---|---|
| 2,716,018 | A | * | 8/1955 | Williams | 175/98 |
| 3,151,690 | A | * | 10/1964 | Grable | 175/321 |
| 3,608,652 | A | * | 9/1971 | Medders et al. | 175/7 |
| 3,638,742 | A | * | 2/1972 | Wallace | 175/325 |
| 3,732,143 | A | * | 5/1973 | Joose | 175/6 |
| 4,534,426 | A | * | 8/1985 | Hooper | 175/65 |
| 4,813,496 | A | * | 3/1989 | Rohweller et al. | 175/7 |
| 5,101,913 | A | * | 4/1992 | Stockley et al. | 175/65 |
| 6,138,774 | A | * | 10/2000 | Bourgoyne, Jr. et al. | 175/7 |

* cited by examiner

*Primary Examiner*—Hoang Dang
(74) *Attorney, Agent, or Firm*—Fleshner & Kim, LLP

(57) ABSTRACT

Apparatus and a method are described for drilling with casing in a borehole in a typically unconsolidated formation, wherein the method involves isolating the annulus between the casing and the borehole section from fluid circulation and creating a hydrostatic pressure in the annulus which is adapted to balance any over-pressurized water in the formation.

11 Claims, 5 Drawing Sheets

METHOD OF FORMING A SUBSEA BOREHOLE FROM A DRILLING VESSEL IN A BODY OF WATER OF KNOWN DEPTH

The present invention relates to improved methods and apparatus for use in the drilling of subsea boreholes, particularly for the recovery of hydrocarbon products from subsea geological formations.

This invention is most directly applicable to the solution of particular problems encountered in the drilling of boreholes in extremely deep water. An example of such operations is the drilling of boreholes in the Gulf of Mexico on the downslope of the continental shelf, in water depths of the order of 6000 to 7000 feet (1830 to 2130 meters), where the hydrocarbon-bearing formation may be a further 10,000 feet (3050 meters) beneath the seabed.

At such depths, the seabed often includes a top layer, usually of the order of 300 to 400 feet (90 to 120 meters) deep, of unconsolidated, mud-like material, followed by a layer of unconsolidated sedimentary rock, before consolidated geologic formation is reached.

Running the borehole casing in deep water seabed conditions of this type is problematic by reason of the unconsolidated nature of the top seabed layers. The unconsolidated sedimentary formations referred to above often contain large, sealed volumes of over-pressured seawater. When a borehole penetrates a region of formation containing such water, the over-pressure causes water to flow out of the formation and into the borehole ("shallow salt water flow"). Such water flow may continue for long periods of time before the pressure in the formation equalises with the "ambient" pressure, and can be likened to the flow of an underwater river. The volume and rate of flow are such that the borehole will normally be completely destroyed or else damaged to the extent that it has to be abandoned.

The invention relates to the particular problem of forming and casing the initial sections of a subsea borehole through layers of unconsolidated formation, where the depth of the unconsolidated formations is small compared to the depth of water in which the operation is to be performed. In order to drill a borehole to the hydrocarbon-bearing formations, it is necessary first of all to drill and stabilise initial borehole sections through the unconsolidated layers.

In the context of drilling operations of this type, it is well known to establish a first borehole section through the first layer of mud-like material using fluid jetting techniques, with the required casing being lowered closely behind the jetting tool so as to stabilise the first borehole section as it is formed. This in itself is a simple form of "casing while drilling", but does not utilise a rotating drill-bit. The depth of the water compared with the required length of casing (typically of the order of 300 feet to 400 feet (90 to 120 meters) is such that the complete casing string can be pre-assembled and hung-off from the drilling vessel with the jetting tool string extending through the casing, before lowering the casing and jetting string to the seabed.

Having established the first section of borehole, typically lined with 36 inch casing, the second section is drilled through the second layer, containing zones of overpressured water, typically using a 24 inch (60.96 cm) bit, and into the underlying formation, to accommodate 20 inch casing. This second borehole section may be of the order of 3000 feet (915 meters) in depth. Using conventional methods, the second borehole would be drilled in its entirety before withdrawing the drill string and running the casing string. If the borehole penetrates a zone of overpressured water, the resulting "shallow water flow" from the overpressured zone into the borehole will destroy or render useless the borehole before the casing can be run. This problem has been addressed in the past by pumping high density drilling fluid through the drill string, so as to fill the borehole with fluid at a higher pressure than the overpressured water in the surrounding formation However, this is extremely expensive, because the drilling fluid cannot be recirculated, and environmentally undesirable, because the drilling fluid is allowed to escape into the subsea environment.

One object of the present invention is therefore to mitigate the above problems by making use of the concept of casing-while-drilling in order to produce a stable, cased borehole through such unconsolidated sedimentary formations containing over-pressured seawater.

A number of additional problems also need to be addressed in order for casing while drilling to be applied in practice. These include the need to control fluid flow paths through the drill and casing strings and the need for blow-out-prevention measures. The most obvious solution to these problems is the use of over-size risers and blow-out-preventers (BOPs) as used in conventional, smaller diameter drilling. However, this is impractical for the large diameter borehole and casing sections with which the present invention is concerned. Cementing a 20 inch casing run so as to obtain a good cement bond in the zones subject to shallow water flow also presents practical difficulties.

Yet further, on certain occasions where the formation is exceptionally weak, the mere running of casing while drilling does not guarantee that the flow of over pressurised water will be controlled. It has been known for such unconsolidated layers to be so soft that the over pressurised water flows up the annulus outside the second section casing and thereafter breaks down the formation outside the 36 inch casing creating a damaging flow path on the outside of the top casing. An example of such an occurrence in recent times may be found in the URSA oil field where the drill template subsided below the mud-line.

In accordance with a first aspect of the present invention, there is provided a method of forming a subsea borehole from a drilling vessel in a body of water of known depth, comprising securing a casing string to a drill string and running said strings, thereby excavating a section of the borehole in a typically unconsolidated formation while isolating the annulus between the casing string and the borehole section from fluid circulation and creating a hydrostatic pressure in the annulus adapted to balance any over pressurised water in the formation.

The method may further comprise the prior steps of:

- forming a first borehole section lined with a first casing having a first diameter;
- making up the drill string and casing string with a second casing having a second diameter which is less than said first diameter, said casing string having an overall length less than the depth of the body of water, and hanging said casing string off from the drilling vessel;
- running said drill string through the interior of said casing string, securing said casing string to said drill string and disconnecting said casing string from said drilling vessel; and
- running said casing string and drill string together into the first borehole section.

Preferably the annulus is isolated from fluid circulation by means of sealing means provided on the outside of the casing string.

Sufficient hydrostatic pressure may be created in the annulus by pumping a suitable gel into the annulus above the sealing means. The gel might typically comprise of a mixed metal hydroxide or mixed metal silicate base. Preferably, the gel is pumped into the annulus during excavation of the said borehole section. Preferably, the first borehole section is formed by means of fluid jetting tool, said first casing being run simultaneously with said fluid jetting tool.

Preferably the said drill string is made up with a drill bit at its lowermost end and with a centraliser assembly incorporated therein above said drill bit.

Preferably also, said casing string is made up with at least a first port collar incorporated therein at a distance from the uppermost end of the casing string which is greater than the length of said first casing.

Preferably, said annular sealing means comprises at least one cup seal element. Most preferably, said sealing means comprises a plurality of cup seal elements spaced along the length of the casing string.

In accordance with a second aspect of the present invention there is provided a casing string having a plurality of sealing means spaced on the outer surface thereof, and further having attached thereto a feed line for the supply of gel into the annulus between the casing string and the second borehole section when the string is run.

Preferably, the casing string is adapted for attachment to a drill string.

Embodiments of the invention will now be described, by way of example only, with reference to the accompanying drawings, in which.

The following description will describe examples of components and assemblies and the methods of use thereof, embodying the various aspects of the invention. In these examples, reference will be made specifically to boreholes, casing strings etc. having particular diameters and other dimensions. It will be understood that these dimensions are of an exemplary nature only and that the invention is not limited to these particular dimensions. The particular example described utilise a first borehole section with 36 inch (91.44 cm) diameter casing and a second borehole section with 20 inch (50.80 cm) casing. Further, references herein to a "drilling vessel" will be understood to include references to drilling rigs or other platforms for offshore drilling operations.

Figure 1:
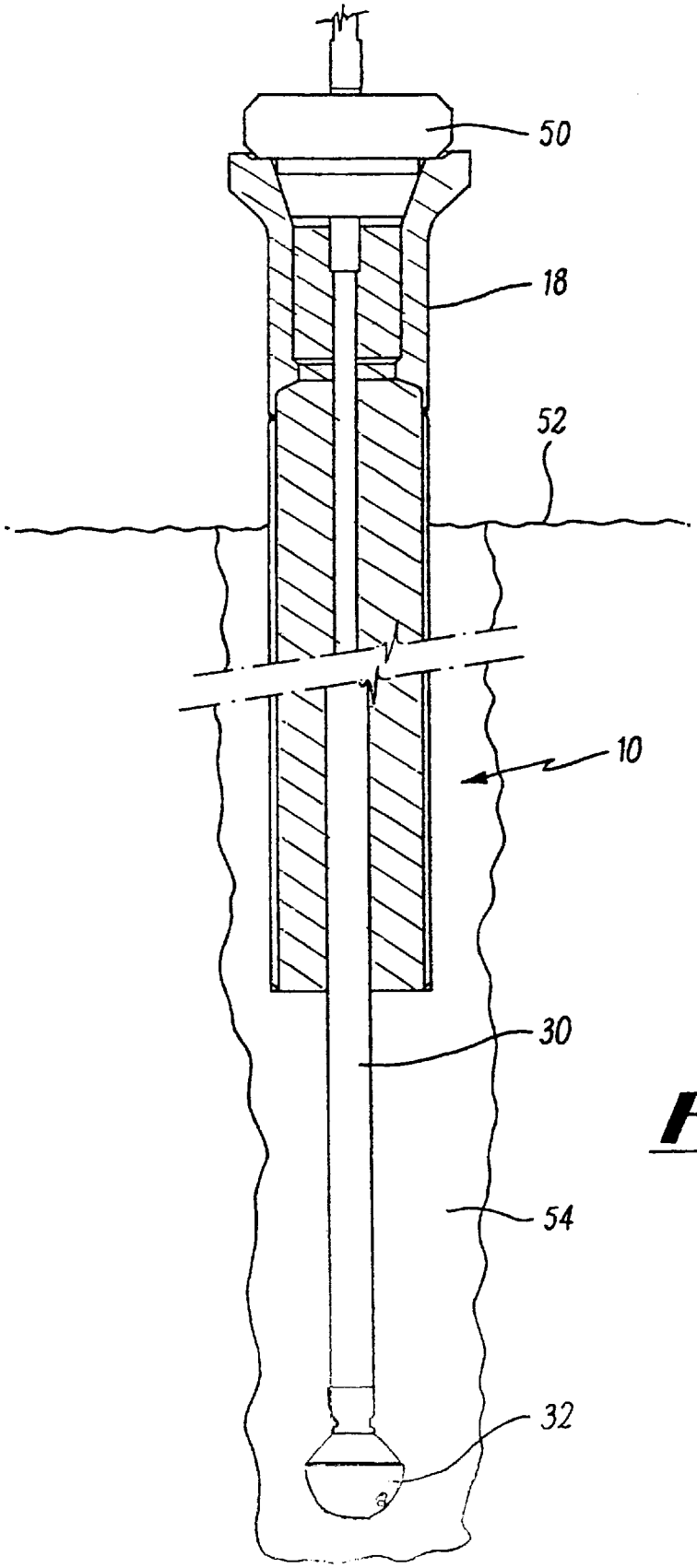
FIG. 1 is a sectional side view of a first borehole section being formed using a jetting string and a first casing string.
Figure 2:
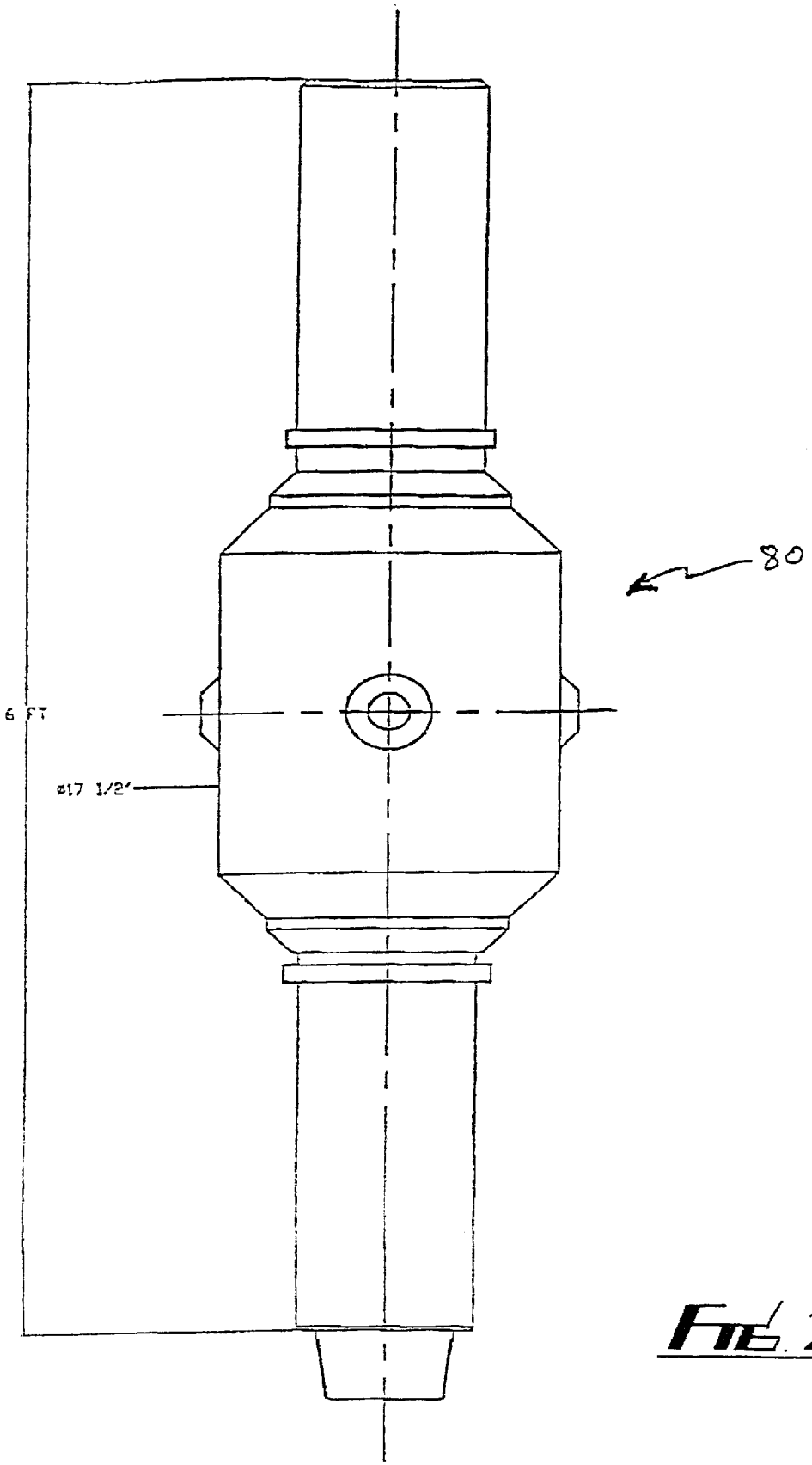
FIG. 2 is a side view of a non-rotating centraliser for use in accordance with the first aspect of the invention.

Referring firstly to FIG. 1, a 36 inch casing string 10 and jetting string 30 are suspended from a running tool 50 via a housing 18. In the example embodiment, the overall arrangement of the 36 inch casing string 10 may include a centraliser joint (not shown) and standard 40 foot (12.19 meter) joints of 36 inch casing. A centraliser such as is illustrated in FIG. 2 may also be provided on the jetting string 30 in order to maintain it in a correct orientation within the borehole. The equipment shown in FIG. 1 may be used in the initial stages of excavating a borehole in unconsolidated layers near the seabed.

The procedure for running the 36 inch casing string 10 and jetting string 30 is as follows:

- make up the casing string 10 and jetting string 30 with jetting tool 32,
- run the jetting tool 32 through the casing string
- make up the housing 18 and running tool 50 and pick up the 36 inch string and run to the mudline 52
- operate the jetting tool 32 to excavate the first borehole section 54 until the housing 18 lands off in a template (not shown) previously installed at the borehole location (as is well known in the art) or until the housing 18 is at a predetermined height above the mudline 52,
- continue circulation of jetting fluid through the jetting tool 32 until the borehole 54 has been cleared of debris,
- discontinue circulation of jetting fluid, disconnect the running tool 50 from the housing 18 and pull out the jetting string 30 back to the drilling vessel.

At this point, the first section of borehole is completed with the 36 inch casing 10 installed.

The next stage of the operation is to excavate a second borehole section while simultaneously running a 20 inch casing into a second borehole section. This requires a 20 inch casing string as illustrated in FIG. 3 and a suitable drill string as shown in FIG. 4.

Figure 3:
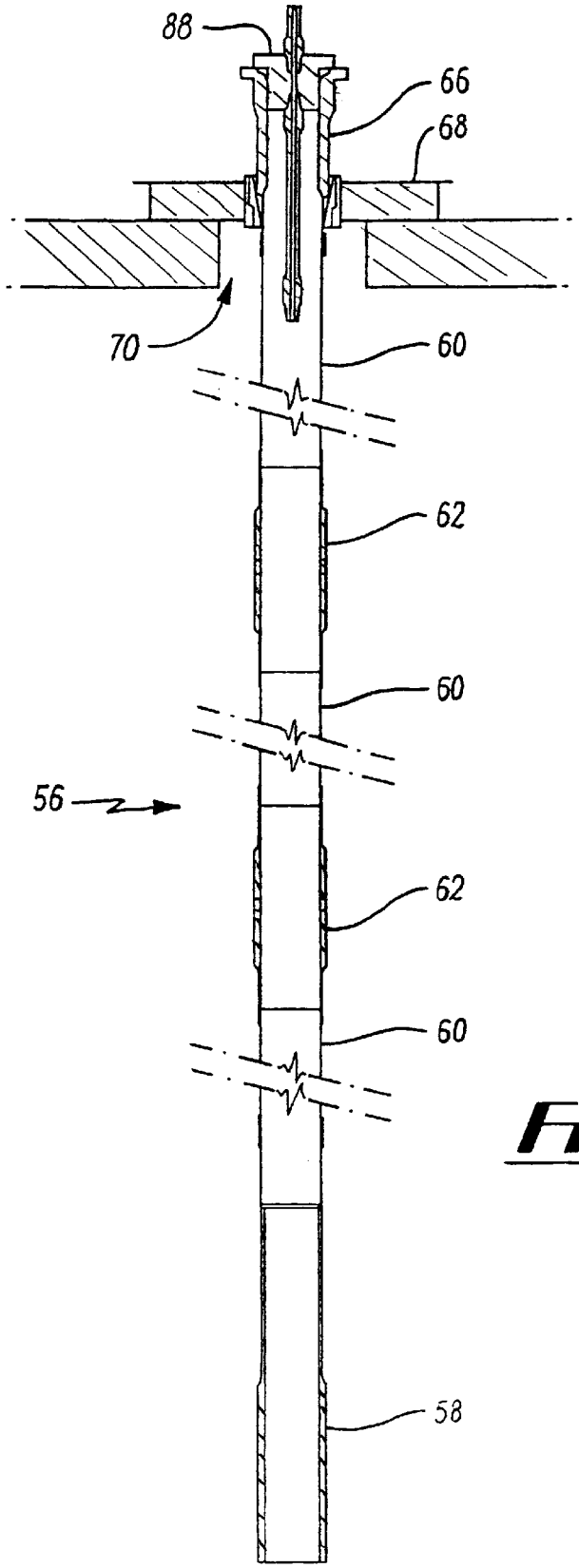
FIG. 3 is a side view of a second casing string assembly for use in accordance with an embodiment of the first aspect of the invention, shown hanging off from the moonpool of a drilling vessel.
Figure 4:
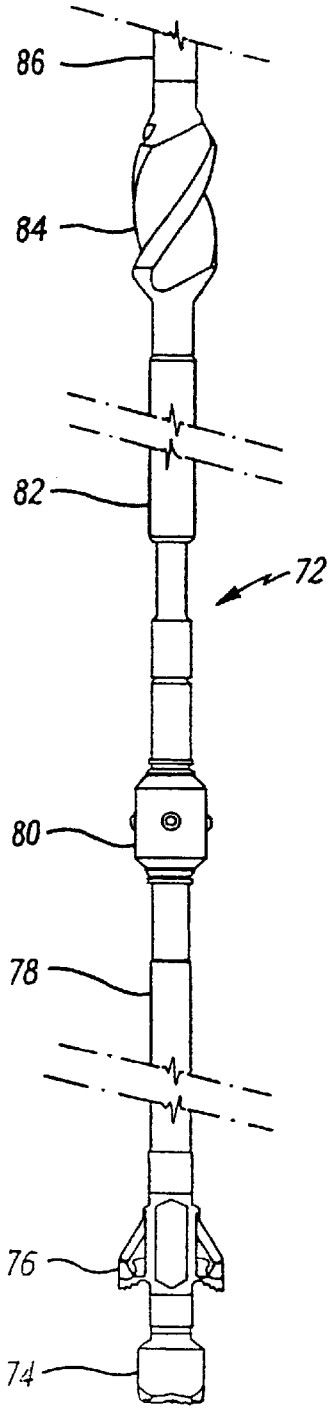
FIG. 4 is a side view of a drill string for use in accordance with the invention.

As illustrated in FIG. 3, the 20 inch casing string 56 comprises a shoe joint 58 at the lowermost end of the casing string, standard joints of 20 inch casing 60, and one or more port collars for use during the cementing of the 20 inch casing.

Figure 5:
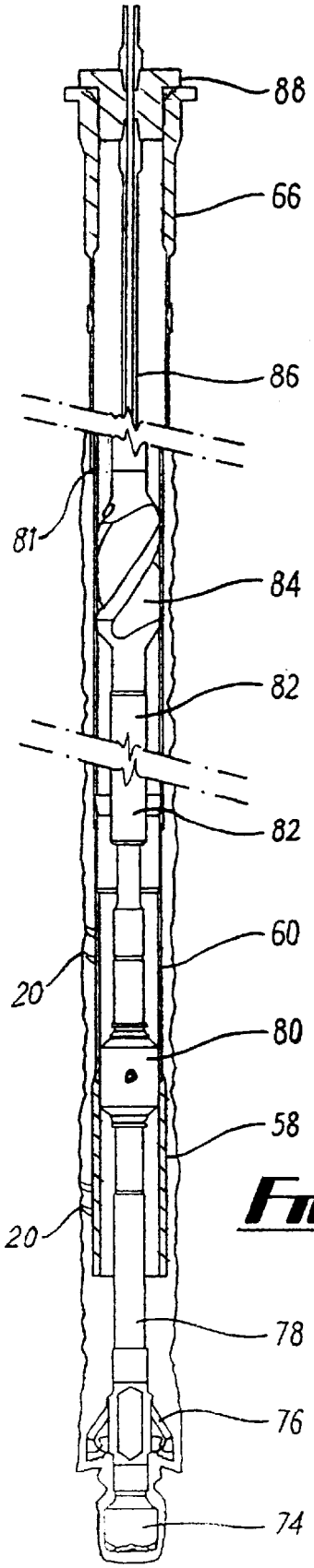
FIG. 5 is a sectional side view of a borehole illustrating the operation of the drill string of FIG. 4 and the casing string of FIG. 3 in drilling a second borehole section in accordance with the invention.
Figure 6:
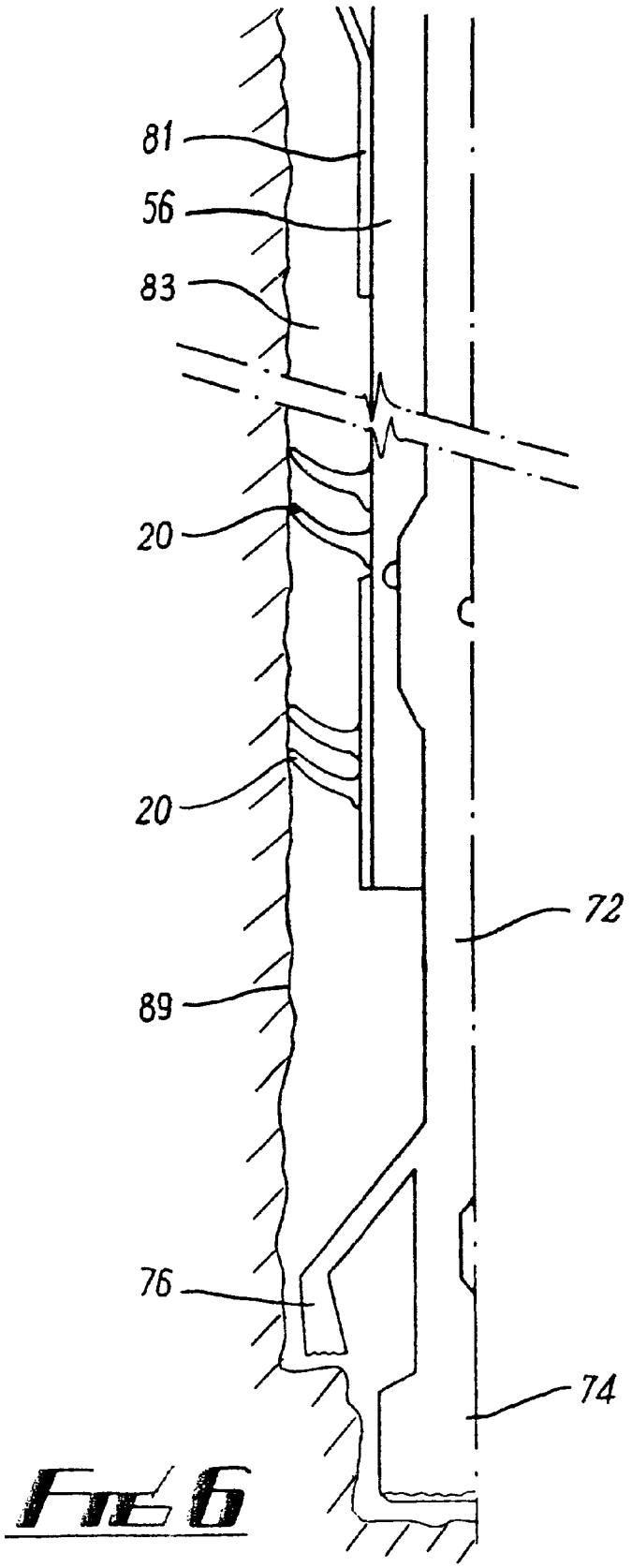
FIG. 6 is a half sectional elevation of a drill string with casing.

The present invention involves the use of a fluid seal in the annulus between the 20 inch casing and the adjacent borehole section. This seal must be maintained while the 20 inch casing is being run into the borehole. The seal is provided on the outer surface of the 20 inch casing string as shown in FIGS. 5 and 6 and includes a plurality of cup seals 20 arranged in series. In this example, the seals 20 are retained in position by removable collars. This arrangement facilitates the removal of the seals 20 for replacement, repair or refurbishment.

The cup seals 20 are designed to hold back the fluid pressure generated by the shallow salt water flows which are expected to be encountered in use of the invention. It will be understood that the number of seals 20, and, if necessary, may be varied to suit the parameters of a particular operation.

The casing string 56 further includes a housing 66. For the purposes of the present invention, the casing string 56 is made up to its complete length and hung off from the drilling vessel. In this example, the string 56 is initially hung off from a wellhead support frame 68 installed in the moonpool 70 of the drilling vessel.

The shoe joint 58 is a heavy wall casing joint which serves to ensure that the 20 inch casing enters the 36 inch seal joint 14 cleanly and without damaging the seals 20 on the second casing string.

Referring to FIG. 4, the 20 inch drill string 72 includes a bottom hole assembly (BHA) comprising, from the bottom up:

- a suitable drilling bit 74, such as a 16 inch roller cone bit,
- an under-reamer 76, suitably a 26 inch device, for opening the hole ahead of the 20 inch casing string (This is a standard item of equipment, having extendable reaming elements which can be retracted to permit running of the tool through a casing of lesser diameter and extended for reaming operations),
- a pony collar 78, suitably a 9.5 inch diameter, 10 foot long collar (a pony collar is a drill collar of non-standard length employed to make up a required string length or spacing, a centraliser, suitably of the non-rotating type (i.e. rotatable relative to the drill string and "non-rotating" relative to the surrounding casing in the event of contact therebetween), which serves to ensure that the casing 56 "follows" the bit and eliminates the possibility of casing wear caused by contact string 56, a positive displacement motor (PDM) 82, suitably a 11.25 inch diameter PDM, a stabiliser 84, suitably of the spiral gauge type, 18.5 inch diameter, which serves to ensure that the SHA is centralised in the 20 inch casing, and conventional drill pipe and drill collars 86, as required.

The drill string 72 is connected to the casing string, in use, by a wellhead running tool 88 (FIG. 5). Minor modification of a standard wellhead running tool is desirable for the purposes of the 20 inch string of the present invention, to provide an adequate flow-by area for the fluid and debris returns from the drilling operation.

With reference now to FIG. 6, attached to the outside of the 20 inch casing string is a feed line or top-up line 81 adapted to supply gel into the annulus 83 between the casing and the borehole wall 89. The introduction of the gel into the annulus serves to provide a hydrostatic pressure that counters the over pressure of the water in the unconsolidated formations.

Accordingly, the entire annulus 83 may be maintained at a pressure that balances or overbalances the overpressured fluid in the unconsolidated layers, with the exception of an approximate 2 to 3 foot gap directly above the bit face on the drill string.

In use it is anticipated that the swab cups 20 may allow some leakage of the gel and this should not be detrimental to the overall working of the invention in preventing the break down of the integrity of the bore hole.

The combination of the gel and cups 20 substantially prevents the flow of well fluid in the annulus, mitigating erosion of the relatively weak formation. It is similarly possible to allow for low or controlled flow levels for the washing of the borehole prior to cementing or for other specific operations. In fact the size of the annulus can be manipulated through the choice of different sized inner pipes, or with the use of fillers, such as buoyancy foams or the like.

The running procedure for the 20 inch casing and drill string is as follows:

Make up and hang-off the 20 inch casing string 56 including the top up line 81;

make up the drill string with a BHA as described above into the interior of the casing string 56, connect the drill string to the casing string, and run the entire casing/drill string assembly on drill pipe connected to the running tool 88 to just above the mudline, lower the assembly slowly to enter the previously installed 36 inch housing 18, establish circulation of drilling fluid through the drill string and run in slowly until the bit 74 and underreamer 76 have exited the 36 inch shoe, drill ahead to target depth while feeding the annulus with gel, and finally withdraw the drill string back to surface.

Once the 20 inch casing 56 has been run and the drill string 72 withdrawn, the 20 inch casing may be cemented in place in the borehole.

The invention therefore provides methods and apparatus enabling a borehole to be established through unconsolidated formations which are liable to shallow salt water flow problems.

"Casing while drilling" is made possible by the fact that the water depth is greater than the required length of 20 inch casing (typically 6000 feet (1830 meters) water depth, compared with the 3000 feet (915 meter) length of the casing string). This allows the entire casing string to be assembled and hung off from the drilling vessel. The drill string can then be run through the pre-assembled casing. The casing string is then hung off from the drill string and detached from the drilling vessel, and can be lowered to the seabed along with the drill string, so that the casing follows closely behind the drill bit as drilling progresses. Accordingly, the borehole is protected by the casing against damage by shallow water flows released during the drilling operation.

Moreover, during the excavation of the borehole, the isolation of at least the majority of the annulus from fluid circulation and the establishment of an appropriate countering hydrostatic pressure enables more successful drilling and casing procedures.

Improvements and modifications can be incorporated without departing from the scope of the invention.

What is claimed is:

1. A method of forming a subsea borehole from a drilling vessel in a body of water of known depth, comprising:

securing a casing string to a drill string; and running said strings, thereby excavating a section of the borehole in a typically unconsolidated formation while isolating an annulus between the casing string and the borehole section from fluid circulation and creating a hydrostatic pressure in the annulus adapted to balance any over pressurized water in the formation.

2. The method as claimed in claim 1, further comprising:

forming a first borehole section lined with a first casing having a first diameter;

making up the drill string and casing string with a second casing having a second diameter which is less than said first diameter, said casing string having an overall length less than the depth of the body of water, and hanging said casing string off from the drilling vessel;

running said drill string through an interior of said casing string, securing said casing string to said drill string and disconnecting said casing string from said drilling vessel; and running said casing string and drill string together into the first borehole section.

3. The method as claimed in claim 1, wherein the annulus is isolated from fluid circulation by means of annular sealing means provided on an outside of the casing string.

4. The method as claimed in claim 3, wherein the balancing hydrostatic pressure is created in the annulus by pumping a suitable gel into the annulus above the annular sealing means.

5. The method as claimed in claim 4, wherein the gel comprises a mixed metal hydroxide or mixed metal silicate base.

6. The method as claimed in claim 4, wherein the gel is pumped into the annulus during excavation of the borehole section.

7. The method as claimed in claim 2, wherein the first borehole section is formed by means of a fluid jetting tool, said first casing being run simultaneously with said fluid jetting tool.

8. The method as claimed in claim 1, wherein the drill string comprises a drill bit at a lowermost end thereof and a centralizer assembly incorporated therein above said drill bit.

9. The method as claimed in claim 1, wherein said casing string comprises at least a first port collar incorporated therein at a distance from an uppermost end of the casing string which is greater than a length of said first casing.

10. The method as claimed in claim 3, wherein said annular sealing means comprises at least one cup seal element.

11. The method as claimed in claim 3, wherein said annular sealing means comprises a plurality of cup seal elements spaced along a length of the casing string.

* * * * *